US010753072B2

(12) United States Patent
Luo et al.

(10) Patent No.: US 10,753,072 B2
(45) Date of Patent: Aug. 25, 2020

(54) HANGING STRUCTURE FOR AN OUTLET TERMINAL SUCH AS A HAND-HELD SHOWER HEAD

(71) Applicant: XIAMEN SOLEX HIGH-TECH INDUSTRIES CO., LTD., Xiamen, Fujian (CN)

(72) Inventors: Weilong Luo, Fujian (CN); Donghai Chen, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 6 days.

(21) Appl. No.: 15/786,151

(22) Filed: Oct. 17, 2017

(65) Prior Publication Data

US 2018/0282985 A1 Oct. 4, 2018

(30) Foreign Application Priority Data

Apr. 1, 2017 (CN) ..... 2017 1 0213339

(51) Int. Cl.
*E03C 1/06* (2006.01)
*A47K 3/28* (2006.01)
*E03C 1/04* (2006.01)

(52) U.S. Cl.
CPC ..... *E03C 1/06* (2013.01); *A47K 3/288* (2013.01); *E03C 1/0408* (2013.01)

(58) Field of Classification Search
CPC .. B05B 1/18; B05B 1/185; B05B 1/60; B05B 1/62; E03C 1/042; E03C 1/06; E03C 1/066; E03C 1/0409; F16L 3/13; F16L 3/1203; F16L 3/12
USPC ..... 4/570; 248/229.2, 229.23, 313, 248/316.1–316.8
See application file for complete search history.

(56) References Cited

U.S. PATENT DOCUMENTS 2,579,878 A * 12/1951 Stone ..... B25B 5/06 248/313
2,705,603 A * 4/1955 Bitz ..... H01Q 1/1228 24/332
3,865,310 A * 2/1975 Elkins ..... E03C 1/06 239/283
4,091,998 A * 5/1978 Peterson ..... E03C 1/06 239/283

(Continued)

*Primary Examiner* — David P Angwin
*Assistant Examiner* — Nicholas A Ros
(74) *Attorney, Agent, or Firm* — Cooper Legal Group, LLC

(57) ABSTRACT

A hanging structure for an outlet terminal includes the outlet terminal; and a hanging element having a limiting component, wherein, when the outlet terminal is moved in a direction away from the hanging element, the outlet terminal is not in contact with the limiting component, the hanging element is in an elastic state which is an open state, an abutting force between the outlet terminal and the hanging element causes the hanging element to be open which permits the outlet terminal to be separated from the hanging element, and wherein, when the outlet terminal swings within the hanging element, the outlet terminal is in contact with the limiting component, the hanging element is in a fixation state which is a closed state, and the outlet terminal is maintained in a hanging state.

10 Claims, 8 Drawing Sheets

(56) References Cited

U.S. PATENT DOCUMENTS

| | | | | |
|---|---|---|---|---|
| 4,211,380 | A * | 7/1980 | Lillegard | A61G 7/0503<br>24/328 |
| 6,024,331 | A * | 2/2000 | Bischoff | E03C 1/06<br>248/229.1 |
| 6,473,916 | B2 * | 11/2002 | Schi.o slashed.dt | E03C 1/06<br>4/567 |
| 8,720,799 | B2 * | 5/2014 | Tseng | E03C 1/06<br>239/443 |
| 8,894,028 | B2 * | 11/2014 | Golden | A61B 1/0014<br>248/230.7 |
| 8,919,379 | B2 * | 12/2014 | Zhou | B05B 1/1618<br>137/625.48 |
| 9,212,784 | B2 * | 12/2015 | Frenal | F17C 13/084 |
| 9,828,752 | B2 * | 11/2017 | Genord | B05B 1/16 |

* cited by examiner

HANGING STRUCTURE FOR AN OUTLET TERMINAL SUCH AS A HAND-HELD SHOWER HEAD

BACKGROUND OF THE INVENTION

1. Field of the Invention

The present invention relates to an installation structure for an outlet terminal, particularly to a hanging structure for an outlet terminal such as a hand-held shower head.

2. Background of the Related Art

When people assemble a shower device, the top spraying shower head is assembled differently from the hand-held shower head. The top spraying shower head is directly fixed to the outlet pipe. The hand-held shower head is connected to a flexible pipe and needs to be hung when not in use. Therefore, a hanging base is needed and may be assembled to the wall. On one hand, the hanging base may damage the wall. On the other hand, when the flexible pipe of the hand-held shower head is pulled, the hand-held shower head swings, making the hand-held shower head easily fall down from the hanging base. The falling hand-held shower head may crash into the wall or into the ground damaging the hand-held shower head. What is more, the falling hand-held shower head may crash into and injure the user.

SUMMARY OF THE INVENTION

The present invention is provided with a hanging structure for an outlet terminal, such as a hand-held shower head, to solve the main technical problem. The outlet terminal can be hung and taken down normally for use. The outlet terminal is prevented from falling down under the action of an abnormal force on the outlet terminal.

To solve the technical problem, the present invention provides a hanging structure for an outlet terminal, comprising a hanging element; and the outlet terminal. When the outlet terminal moves in a direction away from the hanging element, the hanging element is in an elastic state, an abutting force between the outlet terminal and the hanging element causes the hanging element to open, thus allowing the outlet terminal to be separated from the hanging element. When the outlet terminal swings in the hanging element, the hanging element is in a fixation state and the outlet terminal is maintained in a hanging state.

In another preferred embodiment, the hanging element comprises a locking component and a limiting component. When the outlet terminal is moved in a direction away from the hanging element, the locking component separates from the limiting component so that the limiting component has no influence on the locking component, and an abutting force between the outlet terminal and the locking component makes the locking component open. When the outlet terminal swings while in the hanging element, the limiting component abuts against the locking component and is limited so that an abutting force between the outlet terminal and the locking component cannot make the locking component open.

In another preferred embodiment, the locking component comprises two locking arms symmetrically arranged and having a lever structure. Each locking arm has two ends; a first free end and a second free end. When the first free ends of the two locking arms rotate in the opposite direction to one another, they separate from one another about a fulcrum.

At the same time, the second free ends of the two locking arms rotate in the opposite direction from one another to close into each other about the fulcrum.

In another preferred embodiment, when the outlet terminal swings within the hanging element, the limiting component moves to a position between the second free ends of the two locking arms, preventing the second free ends from rotating in the opposite direction to close toward each other about the fulcrum.

In another preferred embodiment, the locking component further comprises a back plate, the limiting component further comprises a limiting driving element disposed at the back plate, and the locking arms are disposed on a surface of the back plate. When the outlet terminal swings within the hanging element, the outlet terminal contacts the limiting driving element, thus triggering the limiting driving element to drive the limiting component to move into a position between the second free ends of the two locking arms.

In another preferred embodiment, the limiting driving element comprises a squeezing surface exposed out of the back plate and a pushing surface abutting against the limiting component. The squeezing surface and the pushing surface rotate about a rotating shaft in a linked manner. When the outlet terminal swings within the hanging element, the squeezing surface and the pushing surface rotate in a linked manner, an abutting force between the pushing surface and the limiting component pushes the limiting component to move into a position between the second free ends of the two locking arms.

In another preferred embodiment, the limiting component further comprises a sliding block having a main body; and a reset spring. The main body of the sliding block is disposed within an axis of symmetry of the two locking arms and abuts against the pushing surface. An abutting force between the pushing surface and the limiting component pushes the sliding block to slide into a position between the second free ends of the two locking arms along the axis of symmetry, and the sliding block, when moving, squeezes the reset spring to restore an elastic reset force to the reset spring.

In another preferred embodiment, the locking component further comprises a torsion spring having one end that is rotatably connected to the fulcrum of the locking arms. The sides of the two locking arms that are opposite to each other are respectively disposed with an arc surface and a clamping chamber is formed between the two locking arms. A side of the clamping chamber disposed away from the back plate is an open end having a width that is smaller than the width of the clamping chamber.

In another preferred embodiment, the outlet terminal is a hand-held shower head.

In another preferred embodiment, the hanging structure further comprises a top spraying shower head having an outlet cover plate and a main body including a portion that is a side plate which is disposed at the same side as the outlet cover plate.

Compared to existing technology, the technical proposal of the present invention has advantages as follows:

1. The present invention provides a hanging structure for an outlet terminal that, when the outlet terminal is separated from the hanging element, a squeezing force between the outlet terminal and the hanging element causes the hanging element to open and permits the outlet terminal to be separated from the hanging element. When the outlet terminal swings within the hanging element due to an abnormal force, the hanging element is in a fixation state and the squeezing force between the outlet terminal and the hanging element cannot permit the hanging element to open so that the outlet terminal is maintained in a normal hanging state.

2. The hanging structure for an outlet terminal of the present invention provides a hanging element that comprises a locking component and a limiting component. The locking component is disposed with a lever structure, so that, when the limiting component moves to a position between respective one ends of two locking components, the locking component is locked so that respective other ends cannot open, thus achieving the object of the present invention.

3. The hanging structure for an outlet terminal of the present invention provides that the limiting component moves to a position between respective one ends of the two locking components due to an abnormal force. In other positions, the limiting component separates from the locking component. Further, the limiting driving element and the reset spring are disposed so that a squeezing surface of the limiting driving element contacts the outlet terminal when the outlet terminal swings within the hanging element due to an abnormal force, so that a pushing surface is caused to rotate about a rotating shaft which causes the pushing surface to push the sliding block to move to a position between respective one ends of the two locking components. At the same time, the sliding block squeezes the reset spring to restore it to a resting force so that, when the abnormal force disappears, the outlet terminal does not act on the limiting driving element and the reset spring drives the sliding blocking to move to an initial position.

4. The hanging structure of an outlet terminal of the present invention provides that the hanging element is disposed on a top spraying shower head so that, when the outlet terminal is a hand-held shower head, the hand-held shower head can be hung on the top spraying shower head. When the flexible pipe of the hand-held shower head is pulled by an external force, the hand-held shower head is prevented from falling down from the hanging element. The integral performance of the two shower heads is improved and the space needed to assemble the shower head is reduced.

DETAILED DESCRIPTION OF THE INVENTION

The present invention will be further described with the drawings and the embodiments.

Figure 1:
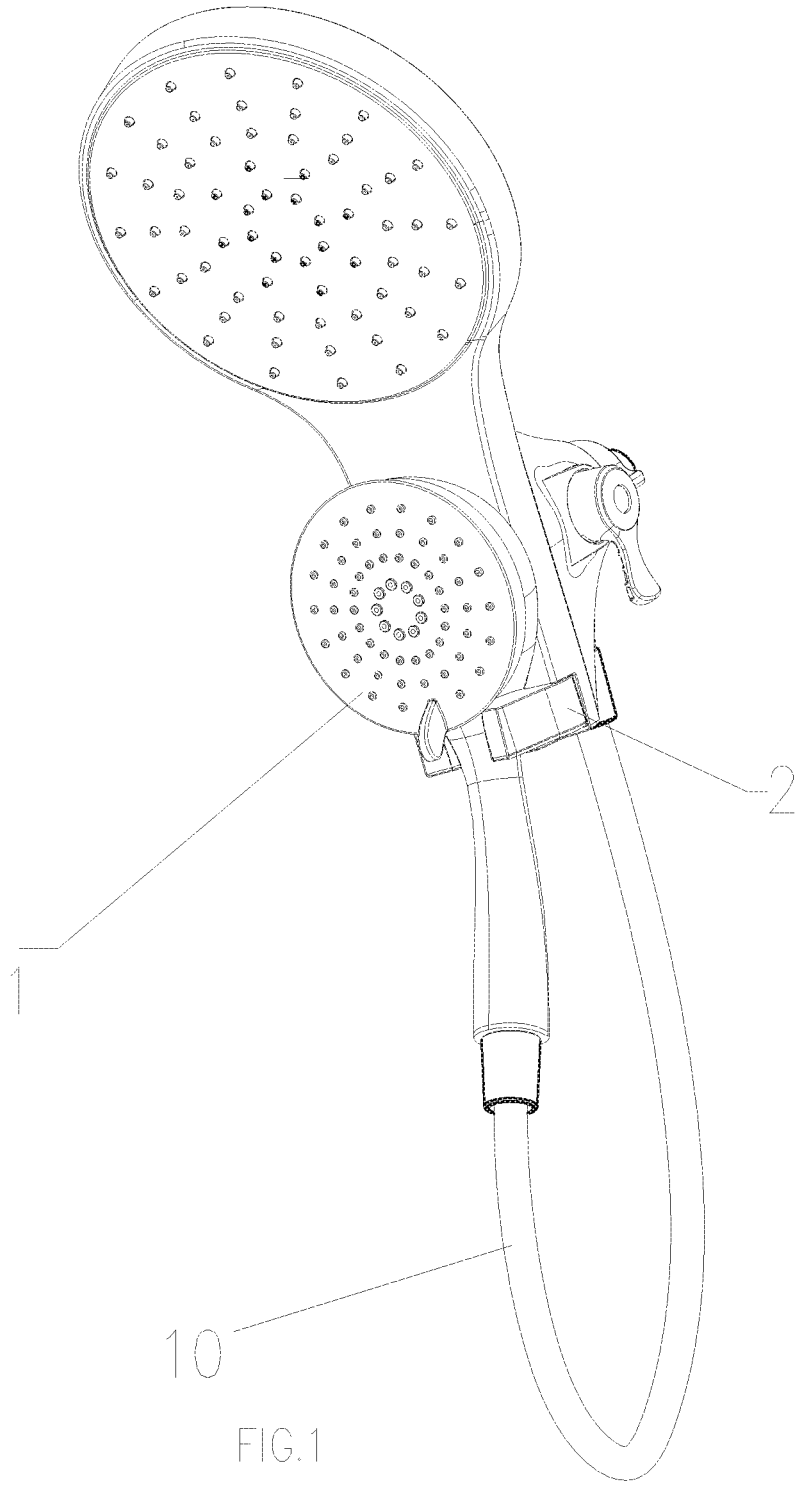
FIG. 1 illustrates a schematic diagram of a preferred embodiment of the hanging structure of the present invention.
Figure 2:
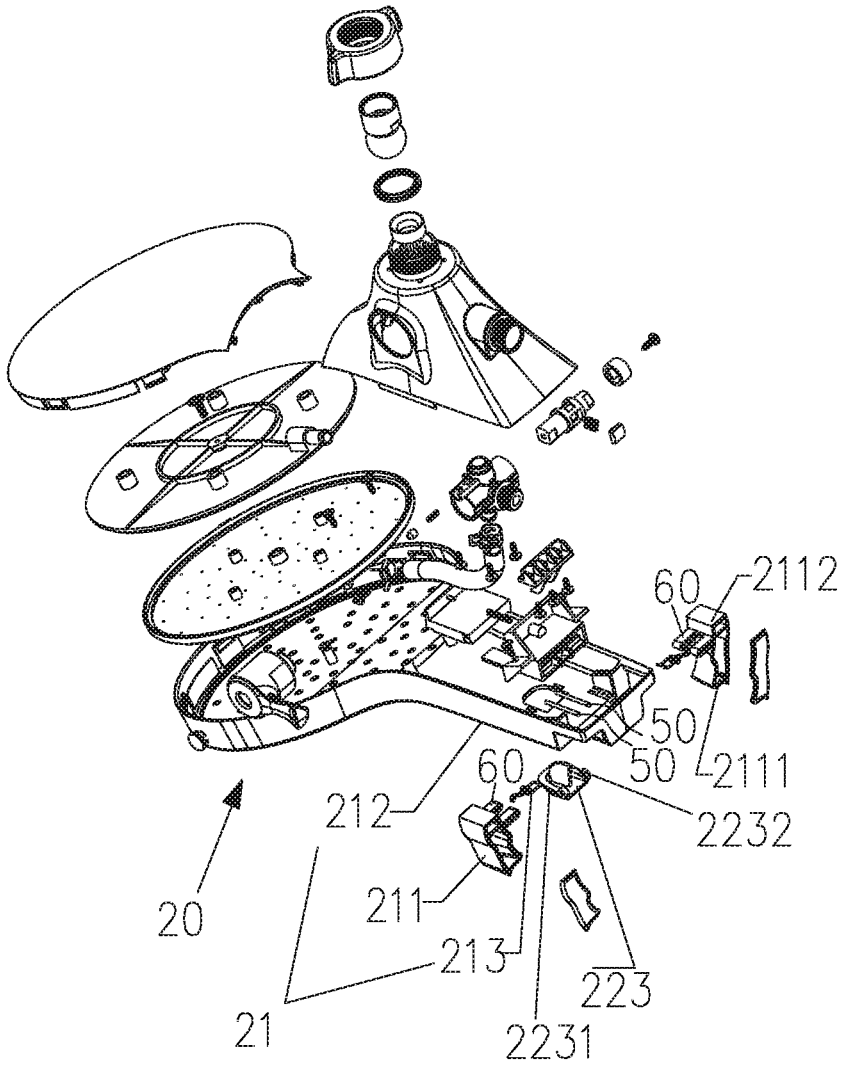
FIG. 2 illustrates an exploded diagram of the preferred embodiment of the present invention.
Figure 3:
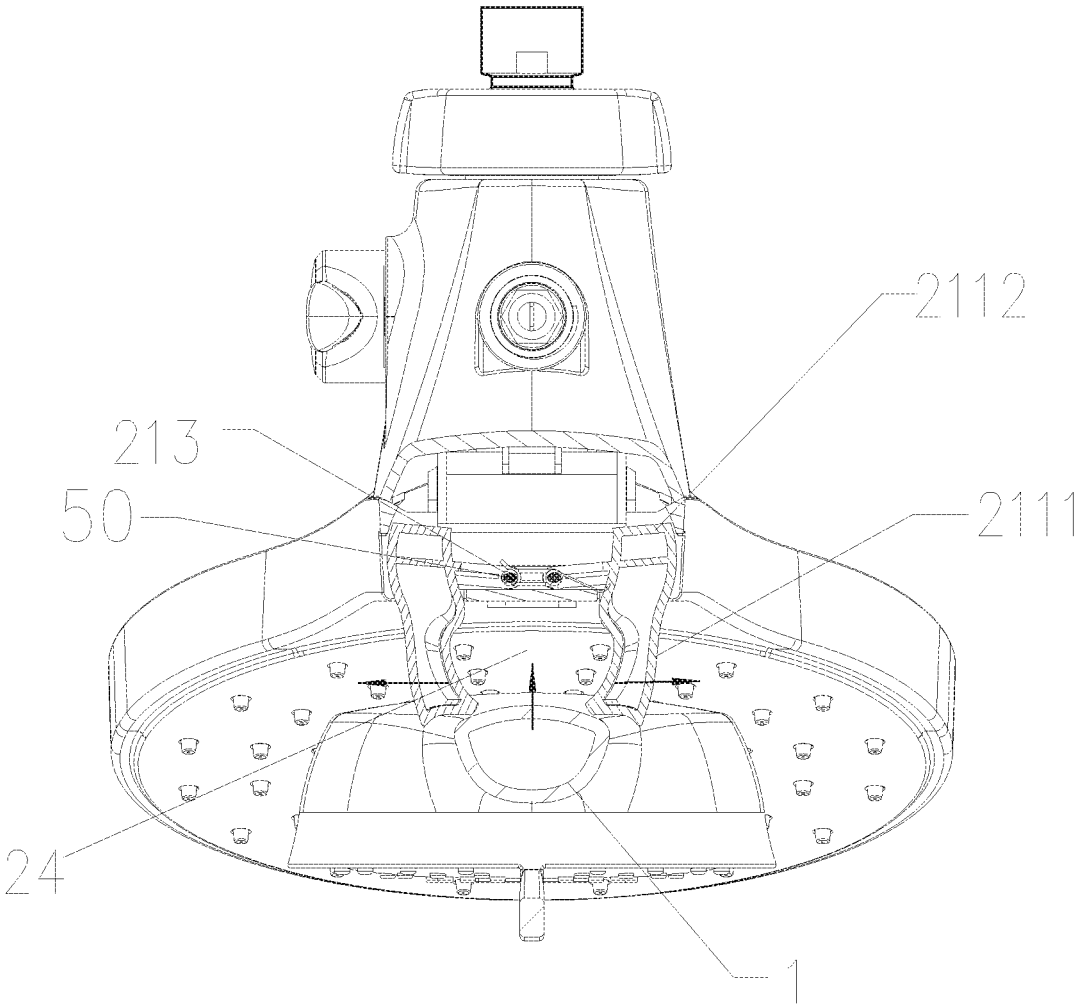
FIG. 3 illustrates a schematic diagram of the preferred embodiment of the present invention when the hand-held shower head is hung on the hanging element.
Figure 4:
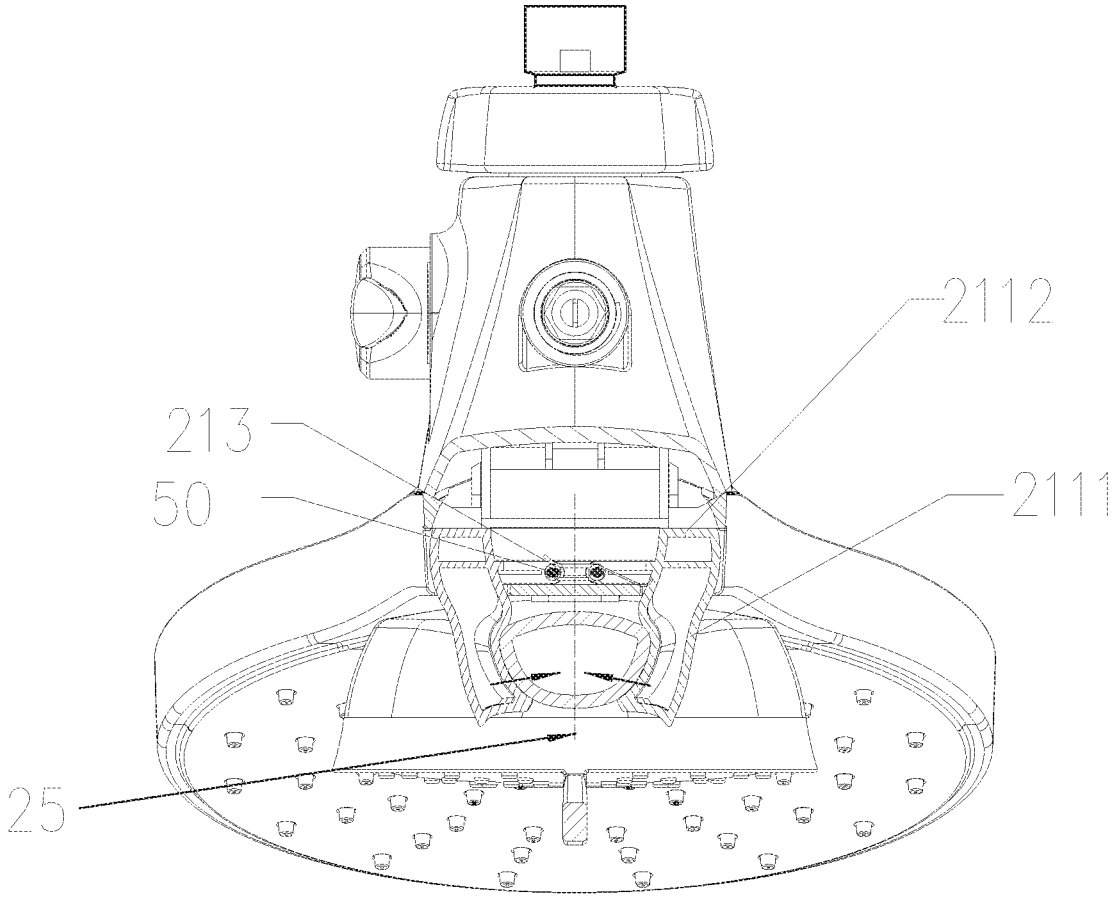
FIG. 4 illustrates a schematic diagram of the preferred embodiment of the present invention when the hand-held shower head is hung on the hanging element normally.
Figure 5:
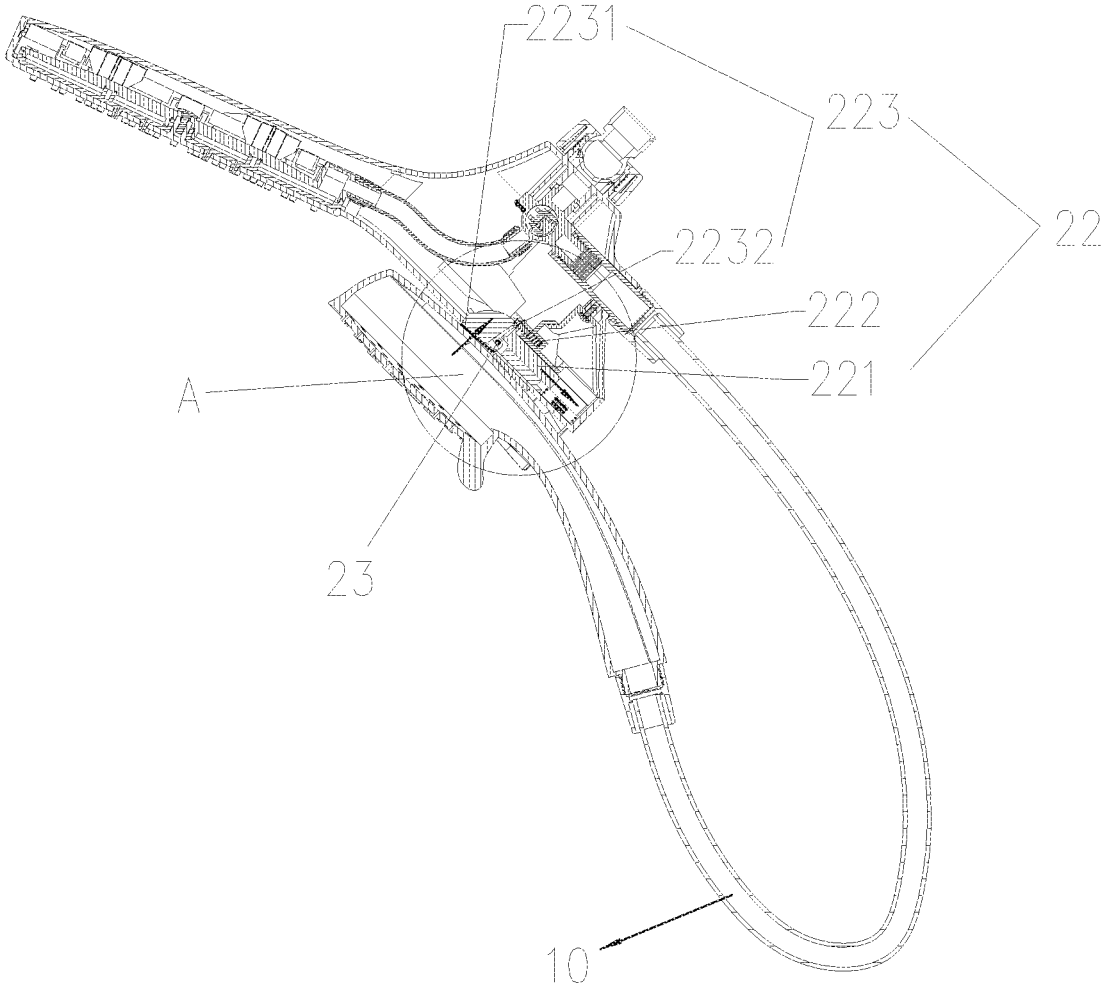
FIG. 5 illustrates a schematic diagram of the preferred embodiment of the present invention showing the motion of the sliding blocking when the flexible pipe of the hand-held shower head is pulled by an abnormal force.
Figure 6:
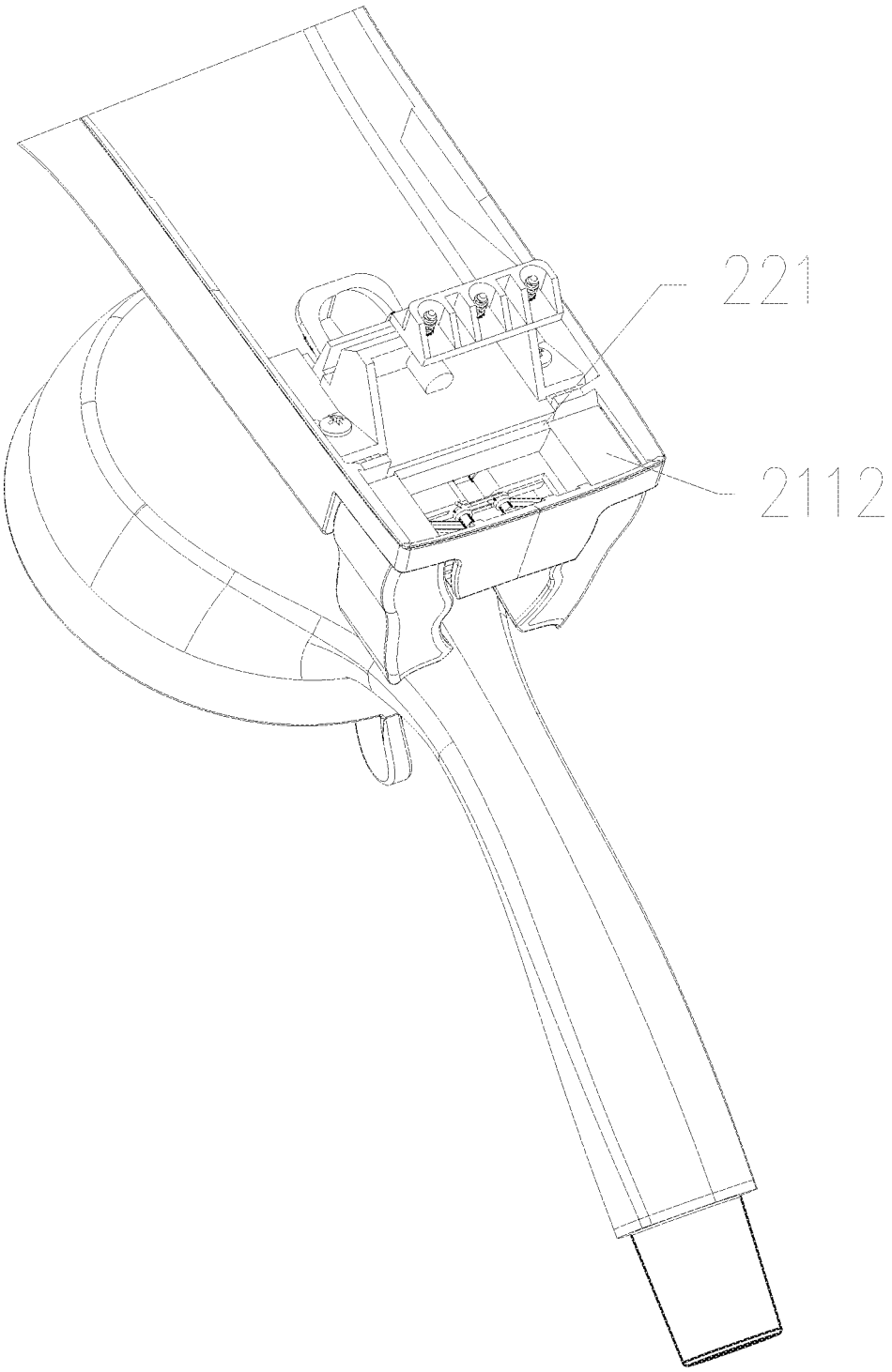
FIG. 6 illustrates a schematic diagram of the preferred embodiment of the present invention showing the positional relationship of the sliding blocking and the locking arm when the flexible pipe of the hand-held shower head is pulled by an abnormal force.
Figure 7:
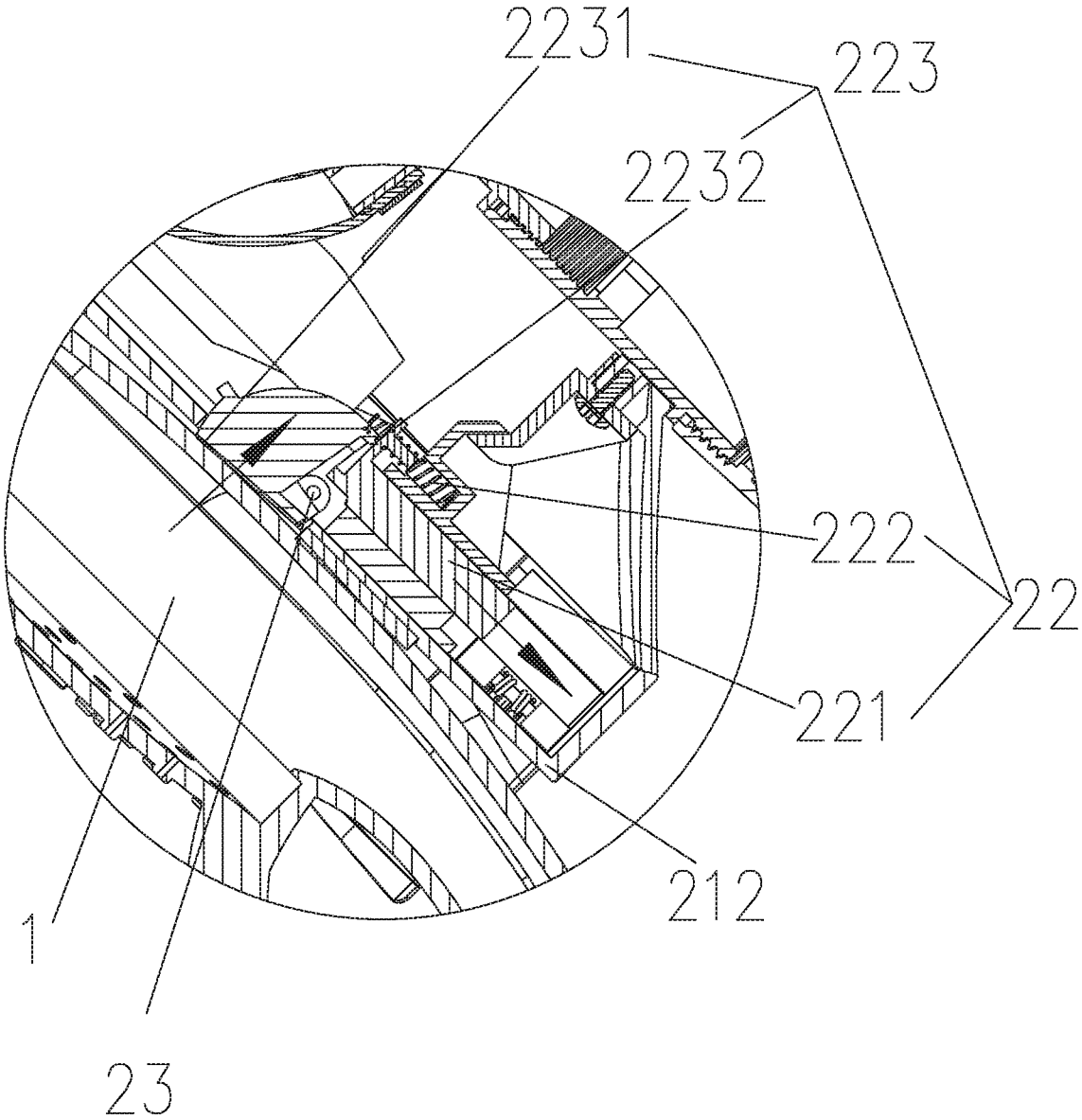
FIG. 7 illustrates an enlarged view of the features circled in FIG. 5.
Figure 8:
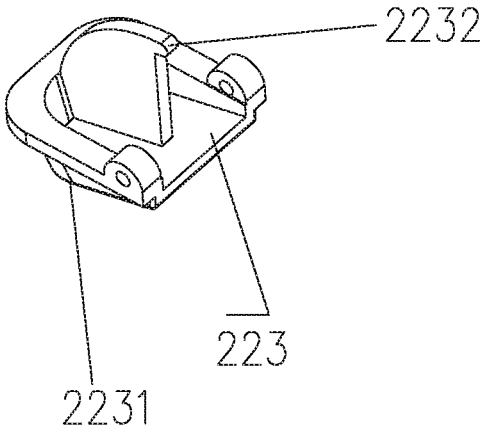
FIG. 8 illustrates a perspective view of a limiting driving element.

Referring to FIGS. 1-8, a hanging structure of an outlet terminal comprises an outlet terminal 1 and a hanging element 2. In this embodiment, the outlet terminal 1 is a hand-held shower head 1 and the hanging element 2 is disposed on a top spraying shower head. It should be noted that the scope of the present invention is not limited to this, since a person skilled in this field can change the hand-held shower head to other outlet terminals, and the hanging element 2 can be directly disposed onto the wall or other positions. These are simple substitutions of the technical proposal of the present invention so that they are not further described herein.

The hanging structure for an outlet terminal also includes a hose 10 through which the outlet terminal 1 connects to the water source.

When the outlet terminal 1 moves in a direction away from the hanging element 2, the hanging element 2 is in an elastic state, and an abutting force between the outlet terminal 1 and the hanging element 2 causes the hanging element 2 to open so that the outlet terminal 1 separates from the hanging element 2. When the outlet terminal 1 swings within the hanging element 2, the hanging element 2 is in a fixation state, and the outlet terminal 1 is maintained in a hanging state. Therefore, when the outlet terminal 1 is separates from the hanging element normally, the hanging element 2 doesn't limit the outlet terminal 1. However, if the outlet terminal 1 experiences an abnormal force, the hanging element 2 limits the movement of the outlet terminal 1, and the outlet terminal 1 is maintained in a hanging state despite the action of the abnormal force which otherwise might cause the outlet terminal 1 to fall down unexpectedly, such as a force that the outlet terminal 1 receives when the user pulls on the hose 10. To achieve above technical effect, the present invention is provided with the structure as follows:

The hanging element 2 comprises a locking component 21 and a limiting component 22. When the outlet terminal 1 moves along a direction away from the hanging element 2, the locking component 21 separates from the limiting component 22 so that the limiting component 22 has no influence on the locking component 21, and an abutting force between the outlet terminal 1 and the locking component 21 causes the locking component 21 to open, and a clamping force of the locking component 21 onto the outlet terminal 1 is released. When the outlet terminal 1 swings within the hanging element 2, the limiting component 22 abuts against the locking component 21 and limits an abutting force between the outlet terminal 1 and the locking component 21 so that the locking component 21 does not open. This ensures that the locking component 21 always clamps the outlet terminal 1 to form a stable hanging structure.

Furthermore, the locking component 21 comprises two locking arms 211 symmetrically arranged and having a lever structure. Each locking arm 211 has two ends, a first free end 2111 and a second free end 2112. A clamping chamber 24 which accommodates the outlet terminal 1 is defined between the first free ends 2111. A clamping force of the first free ends 2111 onto the outlet terminal 1 achieves the hanging of the outlet terminal 1. When the first free ends 2111 of the two locking arms 211 rotate in a direction that is opposite from one another to separate the first free ends 2111 from one another about a fulcrum 60, the second free ends 2112 of the two locking arms 211 rotate in a direction that is opposite from one another to close each other about the fulcrum 60. That is to say, when the first free ends 2111 of the locking arms 211 open, the second free ends 2112 close toward each other. An axis 50 is pass through the fulcrums 60 of the locking component 21.

With this feature, when the outlet terminal 1 swings in the hanging element 2, the limiting component 22 moves to a position between the second free ends 2112 of the two locking arms 211, making the second free ends 2112 unable to rotate in the direction opposite to one another about the fulcrum 60. That is to say, if the second free ends 2112 cannot close toward each other, the first free ends 2111 cannot open. The outlet terminal 1 between the first free ends 2111 is clamped so that it does not fall down.

To achieve movement of the limiting component 22 to a position between the second free ends 2112 of the locking component 21 due to an abnormal force and to other positions, the limiting component 22 separates from the locking component 21. In this embodiment, the locking component 21 further comprises a back plate 212, the limiting component 22 further comprises a limiting driving element 223 disposed at the back plate 212. In this embodiment, the back plate 212 is a side plate 212 and is a portion of a main body of a top side shower head that is disposed at the same side as that of an outlet cover plate 20 of the top side shower head.

The locking arms 211 are disposed on a surface of the back plate 212. When the outlet terminal 1 swings in the hanging element 2, the outlet terminal 1 contacts the limiting driving element 223, thus triggering the limiting driving element 223 to drive the limiting component 22 to move to a position between the second free ends 2112 of the two locking arms 211.

In more detailed, the limiting driving element 223 may comprise a squeezing surface 2231 exposed out of the back plate 212 and a pushing surface 2232 abutting against the limiting component 22. The squeezing surface 2231 and the pushing surface 2232 rotate about a rotating shaft 23 in a linked manner as illustrated in the enlarged view of FIG. 7. When the outlet terminal 1 swings in the hanging element 2, the outlet terminal 1 pushes into the squeezing surface 2231, making the squeezing surface 2231 and the pushing surface 2232 rotate in the linked manner, an abutting force between the pushing surface 2232 and the limiting component 22 pushes the limiting component 22 to move to a position between the second free ends 2112 of the two locking arms 211.

The limiting component 22 may further comprise a sliding blocking 221 and a reset spring 222. The main body of the sliding blocking 221 is disposed within an axis of symmetry 25 of the two locking arms 211 and abuts against the pushing surface 2232. An abutting force between the pushing surface 2232 and the limiting component 22 pushes the sliding blocking 221 to slide to the position between the second free ends 2112 of the two locking arms 211 along the axis of symmetry 25, and the sliding blocking 221, when moving, squeezes the reset spring 222 to accumulate an elastic reset force. When the abnormal force on the outlet terminal 1 disappears, the reset spring 222 drives the sliding blocking 221 to move to an initial position to accomplish a reset.

The locking component 21 may further comprise a torsion spring 213 having one end that is rotatably connected to the fulcrum 60. Sides of the two locking arms 211 that are opposite to one other are respectively disposed with an arc surface so that a clamping chamber 24 is formed between the two locking arms 211. A side of the clamping chamber 24 that is disposed away from the back plate 212 is an open end having a width that is smaller than width of the clamping chamber 24. When the outlet terminal 1 enters the clamping chamber 24, it squeezes the locking arms 211 at the two sides of the open end, making the first free ends 2111 of the locking arm 211 open outwardly. The outlet terminal 1 then enters the clamping chamber 24 normally. After the outlet terminal 1 enters the clamping chamber 24, the locking arms reset under the action of the torsion spring 213 and the locking arms clamps the outlet terminal.

Although the present invention has been described with reference to the preferred embodiments thereof for carrying out the invention, it is apparent to those skilled in the art that a variety of modifications and changes may be made without departing from the scope of the invention which is intended to be defined by the appended claims.

The invention claimed is:

1. A hanging structure for an outlet terminal, comprising:
the outlet terminal,
a hanging element, and
a limiting driving element, wherein:
the hanging element comprises a locking component and a limiting component,
the locking component comprises two locking arms,
the two locking arms are lever structures,
the two locking arms respectively have a first free end and a second free end,
the lever structures are configured to rotate opposite to each other about a fulcrum of each of the lever structures,
the limiting driving element comprises a squeezing surface and a pushing surface linked to the squeezing surface,
when the outlet terminal is moved in a forward direction away from the hanging element:
a first force between the outlet terminal and the locking component, applied due to the outlet terminal being moved in the forward direction, causes the locking component to separate from the limiting component, thereby enabling the first free end and the second free end of each of the two locking arms to rotate to an open state to permit the outlet terminal to be separated from the hanging element,
when the outlet terminal moves in another direction different from the forward direction while disposed within the hanging element:
the outlet terminal contacts the squeezing surface, causing the pushing surface to apply a second force to the limiting component, and
the second force between the pushing surface and a sliding block of the limiting component pushes the sliding block to move into a position between the second free end of each of the two locking arms thereby inhibiting the first free end and the second free end of each of the two locking arms from rotating and inhibiting the outlet terminal from being separated from the hanging element.

2. The hanging structure according to claim 1, wherein:
when the outlet terminal is moved in the forward direction away from the hanging element, the sliding block does not influence the locking component.

3. The hanging structure according to claim 1, wherein:
the two locking arms are arranged symmetrically, the first free end of a first locking arm of the two locking arms rotates about a first fulcrum, the first free end of a second locking arm of the two locking arms rotates about a second fulcrum, the second free end of the first locking arm rotates about the first fulcrum, the second free end of the second locking arm rotates about the second fulcrum, when the first free end of the first locking arm rotates in a direction opposite to the first free end of the second locking arm:

the first free end of the first locking arm separates from the first free end of the second locking arm, the second free end of the first locking arm rotates in a direction opposite to the second free end of the second locking arm, and the second free end of the first locking arm gets closer to the second free end of the second locking arm.

4. The hanging structure according to claim 3, wherein:

when the outlet terminal moves in another direction different from the forward direction while disposed within the hanging element, the sliding block moves into the position between the second free end of each of the two locking arms, preventing the second free ends from rotating in a manner that causes the second free end of the first locking arm to get closer to the second free end of the second locking arm.

5. The hanging structure according to claim 1, wherein:

the hanging element further comprises a back plate, the limiting driving element is disposed on the back plate, and the two locking arms are disposed on a surface of the back plate.

6. The hanging structure according to claim 5, wherein:

the squeezing surface is exposed out of the back plate.

7. The hanging structure according to claim 6, wherein:

the limiting component comprises the sliding block and a reset spring, a main body of the sliding block is disposed within an axis of symmetry of the two locking arms and abuts the pushing surface, and the second force between the pushing surface and the limiting component pushes the sliding block to slide to the position between the second free end of each of the two locking arms along the axis of symmetry.

8. The hanging structure according to claim 7, wherein:

the locking component further comprises a torsion spring having one end that is rotatably connected to the fulcrum of each of the lever structures, the two locking arms have respective sides that are opposite to one another and are respectively disposed with an arc surface, a clamping chamber is formed between the two locking arms, a side of the two locking arms is disposed away from the back plate, and the side defines an open end having a width that is smaller than a width of the clamping chamber.

9. The hanging structure according to claim 8, wherein the outlet terminal is a hand-held shower head.

10. The hanging structure according to claim 9, wherein:

the back plate is disposed at a same side as an outlet cover plate of a top spraying shower head.

* * * * *